US011661568B2

(12) United States Patent
Patterson et al.

(10) Patent No.: US 11,661,568 B2
(45) Date of Patent: May 30, 2023

(54) LAUNDRY DETERGENT COMPOSITION COMPRISING AN ETHYLENE OXIDE-PROPYLENE OXIDE-ETHYLENE OXIDE (EO/PO/EO) TRIBLOCK COPOLYMER AND A LIPASE

(71) Applicant: The Procter & Gamble Company, Cincinnati, OH (US)

(72) Inventors: Steven George Patterson, Newcastle upon Tyne (GB); Jean-Pol Boutique, Gembloux (BE); Johan Maurice Theo De Poortere, Brussels (BE); Nazarmohammad Gulamhussain Momin, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 196 days.

(21) Appl. No.: 17/126,392

(22) Filed: Dec. 18, 2020

(65) Prior Publication Data

US 2021/0115361 A1 Apr. 22, 2021

Related U.S. Application Data

(63) Continuation of application No. PCT/US2019/039205, filed on Jun. 26, 2019.

(30) Foreign Application Priority Data

Jun. 29, 2018 (EP) ..... 18180982
Jun. 12, 2019 (EP) ..... 19179684

(51) Int. Cl.

| | |
|---|---|
| ***C11D 1/72*** | (2006.01) |
| ***C11D 1/722*** | (2006.01) |
| ***C11D 1/22*** | (2006.01) |
| ***C11D 1/83*** | (2006.01) |
| ***C11D 3/386*** | (2006.01) |
| ***C11D 3/43*** | (2006.01) |
| ***C11D 17/04*** | (2006.01) |
| ***C11D 3/20*** | (2006.01) |
| ***C11D 3/37*** | (2006.01) |
| ***C11D 11/00*** | (2006.01) |
| *C11D 1/12* | (2006.01) |

(52) U.S. Cl.

CPC ..... *C11D 3/38627* (2013.01); *C11D 1/83* (2013.01); *C11D 3/2044* (2013.01); *C11D 3/2065* (2013.01); *C11D 3/3707* (2013.01); *C11D 3/38681* (2013.01); *C11D 3/43* (2013.01); *C11D 11/0017* (2013.01); *C11D 17/043* (2013.01); *C11D 1/12* (2013.01); *C11D 1/22* (2013.01); *C11D 1/722* (2013.01)

(58) Field of Classification Search

None

See application file for complete search history.

(56) References Cited

U.S. PATENT DOCUMENTS

| | | | | |
|---|---|---|---|---|
| 5,945,394 | A * | 8/1999 | Sajic | C11D 1/28 560/147 |
| 6,211,129 | B1 * | 4/2001 | Gladfelter | C11D 17/044 510/447 |
| 6,462,008 | B1 * | 10/2002 | Ortiz | D06L 4/636 510/303 |
| 2007/0173429 | A1 * | 7/2007 | Souter | C11D 3/38627 510/392 |
| 2016/0095496 | A1 * | 4/2016 | Keuleers | A47K 5/122 134/25.2 |
| 2016/0201012 | A1 * | 7/2016 | Ferrieux | C11D 3/3769 510/230 |
| 2016/0208197 | A1 * | 7/2016 | Backer | C11D 3/378 |
| 2018/0216053 | A1 * | 8/2018 | Denome | C11D 1/37 |
| 2019/0233784 | A1 * | 8/2019 | Sivik | C11D 17/042 |

FOREIGN PATENT DOCUMENTS

| | | | |
|---|---|---|---|
| EP | 1726636 | A1 | 11/2006 |
| JP | 2008507611 | A | 3/2008 |
| JP | 2008531758 | A | 8/2008 |
| WO | 2006020010 | A1 | 2/2006 |
| WO | 2017036901 | A1 | 3/2017 |

OTHER PUBLICATIONS

Extended European Search Report and Search Opinion; Application No. 18180982.3; dated Sep. 12, 2018; 5 pages.
Extended European Search Report and Search Opinion; Application No. 19179684.6; dated Oct. 31, 2 019; 5 pages.
International Search Report and Written Opinion; Application No. US2019/039205; dated Oct. 30, 2019; 9 pages.

* cited by examiner

*Primary Examiner* — Lorna M Douyon
(74) *Attorney, Agent, or Firm* — Andrew J. Mueller; Gregory S. Darley-Emerson

(57) ABSTRACT

A laundry detergent composition containing an ethylene oxide-propylene oxide-ethylene oxide (EO/PO/EO) triblock copolymer and a lipase enzyme and use of an ethylene oxide-propylene oxide-ethylene oxide (EO/PO/EO) triblock copolymer and lipase enzyme in the laundry detergent composition.

20 Claims, 1 Drawing Sheet

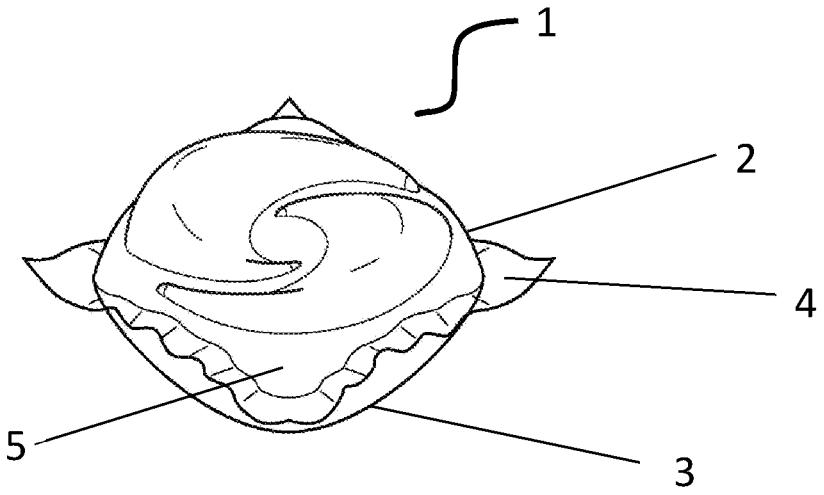
1
2
4
5
3

LAUNDRY DETERGENT COMPOSITION COMPRISING AN ETHYLENE OXIDE-PROPYLENE OXIDE-ETHYLENE OXIDE (EO/PO/EO) TRIBLOCK COPOLYMER AND A LIPASE

FIELD OF THE INVENTION

The present disclosure relates to a laundry detergent composition that includes an ethylene oxide-propylene oxide-ethylene oxide (EO/PO/EO) triblock copolymer and a lipase enzyme. The disclosure also relates to the use of an ethylene oxide-propylene oxide-ethylene oxide (EO/PO/EO) triblock copolymer and lipase enzyme in such laundry detergent compositions.

BACKGROUND OF THE INVENTION

Consumers use laundry detergent compositions during the laundry process. Such laundry detergent compositions provide cleaning, freshness and/or care benefits to the fabrics during the laundry operation. While laundry detergent formulations have already been optimized for cleaning stains from fabrics including greasy stains, there is a continued need for further improvement.

There is also an increasing trend to limit the amount and level of chemicals formulated into laundry detergents in order to minimize their environmental footprint, as well as to control formulation cost in order to maintain them affordable to consumers.

Laundry detergents have been available to consumers in powder, liquid and since recent years also as water soluble unit dose articles. Water-soluble unit dose articles comprising liquid and/or powder laundry detergent compositions are liked by consumers as being convenient and efficient to use. These unit dose articles however bring the additional space limitation to the formulator, hence enforcing the need for highly effective formulation approaches.

As such there is a need to identify formulation approaches that further improve the stain removal performance of laundry detergents, in particular, the greasy stain removal performance, whilst minimizing the amount or level of formulation actives to be used.

SUMMARY OF THE INVENTION

The present disclosure relates to a laundry detergent composition, which includes a lipase and an ethylene oxide-propylene oxide-ethylene oxide (EO/PO/EO) triblock copolymer, where the copolymer includes a first EO block, a second EO block, and a PO block, where the first EO block and the second EO block are linked to the PO block, where the laundry detergent composition includes between 0.0001% and 0.75%, by weight of the laundry detergent composition of the lipase, based on active protein.

The present disclosure also relates to the use of an ethylene oxide-propylene oxide-ethylene oxide (EO/PO/EO) triblock copolymer and a lipase to improve the grease cleaning performance of a laundry detergent composition according to the present disclosure.

BRIEF DESCRIPTION OF THE DRAWINGS

FIG. 1 is a water-soluble unit dose article according to the present disclosure.

DETAILED DESCRIPTION OF THE INVENTION

It has now surprisingly been found that co-formulation of an ethylene oxide-propylene oxide-ethylene oxide (EO/PO/EO) triblock copolymer together with a lipase enzyme into a laundry detergent formulation results in a synergistic grease cleaning performance Additionally, malodor typically observed when applying lipases into washing processes has also been found to be reduced.

Laundry Detergent Composition

The present disclosure relates to a laundry detergent formulation comprising an ethylene oxide-propylene oxide-ethylene oxide (EO/PO/EO) triblock copolymer and a lipase. The ethylene oxide-propylene oxide-ethylene oxide (EO/PO/EO) triblock copolymer and the lipase are described in more detail further herein.

The laundry detergent composition may be a powder, a liquid or a mixture thereof.

The solid laundry detergent composition may comprise solid particulates or may be a single homogenous solid. Preferably, the solid laundry detergent composition comprises particles. This means the solid laundry detergent composition comprises individual solid particles as opposed to the solid being a single homogenous solid. The particles may be free-flowing or may be compacted, preferably free-flowing.

The term 'liquid laundry detergent composition' refers to any laundry detergent composition comprising a liquid capable of wetting and treating a fabric, and includes, but is not limited to, liquids, gels, pastes, dispersions and the like. The liquid composition can include solids or gases in suitably subdivided form, but the liquid composition excludes forms which are non-fluid overall, such as powders, tablets or granules.

The laundry detergent composition may be present in a water-soluble unit dose article and the water-soluble unit dose article comprises a water-soluble film.

The water-soluble unit dose article comprises a water-soluble film and a laundry detergent composition. The laundry detergent composition and the water-soluble film are described in more detail below.

The water-soluble unit dose article comprises the water-soluble film shaped such that the unit-dose article comprises at least one internal compartment surrounded by the water-soluble film, and wherein the laundry detergent composition is present within said compartment. The unit dose article may comprise a first water-soluble film and a second water-soluble film sealed to one another such to define the internal compartment. The water-soluble unit dose article is constructed such that the laundry detergent composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the detergent composition. During manufacture, a first water-soluble film may be shaped to comprise an open compartment into which the detergent composition is added. A second water-soluble film is then laid over the first film in such an orientation as to close the opening of the compartment. The first and second films are then sealed together along a seal region.

The unit dose article may comprise more than one compartment, even at least two compartments, or even at least three compartments. The compartments may be arranged in superposed orientation, i.e. one positioned on top of the other. In such an orientation the unit dose article will comprise three films, top, middle and bottom. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively, one compartment may be completely enclosed within another compartment.

Wherein the unit dose article comprises at least two compartments, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the laundry detergent composition according to the present invention may be comprised in at least one of the compartments. It may for example be comprised in just one compartment, or may be comprised in two compartments, or even in three compartments.

Each compartment may comprise the same or different compositions. The different compositions could all be in the same form, or they may be in different forms.

The water-soluble unit dose article may comprise at least two internal compartments, wherein the liquid laundry detergent composition is comprised in at least one of the compartments, preferably wherein the unit dose article comprises at least three compartments, wherein the detergent composition is comprised in at least one of the compartments.

FIG. 1 discloses a water-soluble unit dose article (1) according to the present invention. The water-soluble unit dose article (1) comprises a first water-soluble film (2) and a second water-soluble film (3) which are sealed together at a seal region (4). The laundry detergent composition (5) is comprised within the water-soluble soluble unit dose article (1).

The film of the present invention is soluble or dispersible in water. The water-soluble film preferably has a thickness of from 20 to 150 micron, preferably 35 to 125 micron, even more preferably 50 to 110 micron, most preferably about 76 micron.

Preferably, the film has a water-solubility of at least 50%, preferably at least 75% or even at least 95%, as measured by the method set out here after using a glass-filter with a maximum pore size of 20 microns:

5 grams±0.1 gram of film material is added in a pre-weighed 3 L beaker and 2 L±5 ml of distilled water is added. This is stirred vigorously on a magnetic stirrer, Labline model No. 1250 or equivalent and 5 cm magnetic stirrer, set at 600 rpm, for 30 minutes at 30° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by solution casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers and/or copolymers can also be used as the pouch material, especially mixtures of polyvinylalcohol polymers and/or copolymers, especially mixtures of polyvinylalcohol homopolymers and/or anionic polyvinylalcohol copolymers preferably selected from sulphonated and carboxylated anionic polyvinylalcohol copolymers especially carboxylated anionic polyvinylalcohol copolymers. Most preferably the water soluble film comprises a blend of a polyvinylalcohol homopolymer and a carboxylated anionic polyvinylalcohol copolymer.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M8310.

The film may be opaque, transparent or translucent. The film may comprise a printed area.

The area of print may be achieved using standard techniques, such as flexographic printing or inkjet printing.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

It was further surprisingly found that the ethylene oxide-propylene oxide-ethylene oxide (EO/PO/EO) triblock copolymer, when formulated into a water-soluble unit dose article, improved the structural integrity of the water-soluble film, i.e. minimised film swelling, whilst still minimising film brittleness. Overall physical phase stability of the detergent composition, when formulated into a liquid form, especially a low water or non-aqueous liquid form, has also been found to be improved. A further benefit of the present invention is it allows for overall reduced levels of non-aqueous solvent whilst still ensuring unit dose article strength and minimized film brittleness, and minimized instability of the liquid laundry detergent composition. Hence, within compacted water soluble unit dose articles, the ethylene oxide-propylene oxide-ethylene oxide (EO/PO/EO) triblock copolymer provides a double benefit of improving water-soluble unit dose article strength and providing grease cleaning benefits. This means that non-aqueous solvent and/or fatty alcohol ethoxylate levels in the water-soluble unit dose article can be reduced without compromise on unit dose article strength, film brittleness or cleaning performance.

The laundry detergent composition can be used in a fabric hand wash operation or may be used in an automatic machine fabric wash operation.

The laundry detergent composition, preferably liquid laundry detergent composition comprises an ethylene oxide-propylene oxide-ethylene oxide (EO/PO/EO) triblock copolymer, wherein the copolymer comprises a first EO block, a second EO block and a PO block wherein the first EO block and the second EO block are linked to the PO block. In other words, the PO block is located between the two EO blocks.

By 'linked to the PO block', we mean herein that the EO-PO-EO blocks have the following structure;

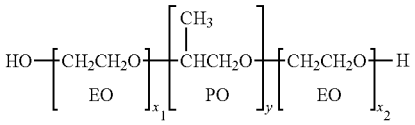

wherein $X_1$ is preferably on average between 2 and 90, preferably between 3 and 50 more preferably between 4 and 20, even more preferably between 5 and 15, most preferably between 10 and 15;

$X_2$ is preferably on average between 2 and 90, preferably between 3 and 50 more preferably between 4 and 20, even more preferably between 5 and 15, most preferably between 10 and 15;

Y is preferably on average between 15 and 70, preferably between 20 and 60, more preferably between 25 and 50, even more preferably between 25 and 40, most preferably between 25 and 35.

Preferably, the laundry detergent composition comprises between 1% and 10%, preferably between 2% and 8% by weight of the laundry detergent composition of the ethylene oxide-propylene oxide-ethylene oxide (EO/PO/EO) triblock copolymer.

Preferably, the ethylene oxide-propylene oxide-ethylene oxide (EO/PO/EO) triblock copolymer has an average propylene oxide chain length of between 15 and 70, preferably between 20 and 60, more preferably between 25 and 50, even more preferably between 25 and 40, most preferably between 25 and 35 propylene oxide units.

Preferably, the ethylene oxide-propylene oxide-ethylene oxide (EO/PO/EO) triblock copolymer has an average molecular weight of between 1000 and 10,000, preferably between 1500 and 5000 more preferably between 2000 and 4500, even more preferably between 2500 and 4000, most preferably between 2500 and 3000.

Preferably, each ethylene oxide chain independently has an average chain length of between 2 and 90, preferably between 3 and 50 more preferably between 4 and 20, even more preferably between 5 and 15, most preferably between 10 and 15 ethylene oxide units.

Preferably, the copolymer comprises on average between 10% and 90%, preferably between 20% and 70%, most preferably between 30% and 50% by weight of the copolymer of the combined ethylene-oxide blocks. Most preferably the total ethylene oxide content is split over the two ethylene oxide blocks such that each ethylene oxide block comprises on average between 40% and 60% preferably between 45% and 55%, even more preferably between 48% and 52%, most preferably 50% of the total number of ethylene oxide units, wherein the percentage of both ethylene oxide blocks together accounts for 100% of the ethylene oxide units present.

Most preferably the copolymer has an average molecular weight between 2500 and 3000, an average propylene oxide content between 25 and 35 propylene oxide units, and an average ethylene oxide content of between 10 and 15 ethylene oxide units per ethylene oxide block. Without wishing to be bound by theory, a further benefit of the ethylene oxide-propylene oxide-ethylene oxide (EO/PO/EO) triblock copolymer is that they exhibit good safety profiles. Most preferred are copolymers having an average molecular weight between 2500 and 3000, an average propylene oxide content between 25 and 35 propylene oxide units, and an average ethylene oxide content of between 10 and 15 ethylene oxide units per ethylene oxide block as these have the best safety profile of this class of copolymers wherein they especially exhibit minimal skin and eye irritation if accidentally contacted with skin or eye.

Suitable ethylene oxide-propylene oxide-ethylene oxide triblock copolymers are commercially available under the Pluronic PE series from the BASF company, or under the Tergitol L series from the Dow Chemical Company. A particularly suitable material is Pluronic PE 6400 or Tergitol L64.

Without wishing to be bound by theory, a further benefit of the ethylene oxide-propylene oxide-ethylene oxide (EO/PO/EO) triblock copolymer is that they exhibit good safety profiles wherein they especially exhibit minimal skin and eye irritation if accidentally contacted with skin or eye.

The laundry detergent composition, preferably liquid laundry detergent composition comprises a lipase enzyme. The laundry detergent composition comprises between 0.0001% and 0.75%, preferably between 0.0005% and 0.5%, more preferably between 0.001% and 0.5% by weight of the laundry detergent composition of the lipase, based on active protein.

Suitable lipases include those of bacterial or fungal origin. Chemically modified or protein engineered mutants are included. Examples of useful lipases include lipases from *Humicola* (synonym *Thermomyces*), e.g., from *H. lanuginosa* (*T. lanuginosus*), or from *H. insolens*, a *Pseudomonas* lipase, e.g., from *P. alcaligenes* or *P. pseudoalcaligenes, P. cepacia, P. stutzeri, P. fluorescens, Pseudomonas* sp. strain SD 705, *P. wisconsinensis*, a *Bacillus* lipase, e.g., from *B. subtilis, B. stearothermophilus* or *B. pumilus.*

Preferred lipases are first-wash lipases. In one embodiment of the invention the composition comprises a first wash lipase.

First wash lipases include a lipase which is a polypeptide having an amino acid sequence which:

(a) has at least 90% identity with the wild-type lipase derived from *Humicola lanuginosa* strain DSM 4109; or (b) compared to said wild-type lipase, comprises a substitution of an electrically neutral or negatively charged amino acid at the surface of the three-dimensional structure within 15 A of E1 or Q249 with a positively charged amino acid;

or a mixture of (a) and (b);

preferably wherein (a) or (b) or a mixture thereof comprises;

(c) a peptide addition at the C-terminal; or (d) a peptide addition at the N-terminal;

(e): i) a negative amino acid in position E210 of said wild-type lipase; ii) a negatively charged amino acid in the region corresponding to positions 90-101 of said wild-type lipase; and iii) comprises a neutral or negative amino acid at a position corresponding to N94 or said wild-type lipase and/or has a negative or neutral net electric charge in the region corresponding to positions 90-101 of said wild-type lipase;

(f) or a mixture thereof.

More preferably, the lipase is a polypeptide having an amino acid sequence which:

(a) has at least 90% identity with the wild-type lipase derived from *Humicola lanuginosa* strain DSM 4109; and (b) compared to said wild-type lipase, comprises a substitution of an electrically neutral or negatively charged amino acid at the surface of the three-dimensional structure within 15 A of E1 or Q249 with a positively charged amino acid;

preferably the combination of (a) and (b) comprise;

(c) a peptide addition at the C-terminal; or (d) a peptide addition at the N-terminal;

(e): i) a negative amino acid in position E210 of said wild-type lipase; ii) a negatively charged amino acid in the region corresponding to positions 90-101 of said wild-type lipase; and iii) comprises a neutral or negative amino acid at a position corresponding to N94 or said wild-type lipase and/or has a negative or neutral net electric charge in the region corresponding to positions 90-101 of said wild-type lipase;

(f) or a mixture thereof.

Preferred are variants of the wild-type lipase from *Thermomyces lanuginosus* comprising one or more of the T231R and N233R mutations. The wild-type sequence is the 269 amino acids (amino acids 23-291) of the Swissprot accession number Swiss-Prot 059952 (derived from *Thermomyces lanuginosus* (*Humicola lanuginosa*)). Preferred lipases would include those sold under the tradenames Lipex®, Lipex Evity®, Lipolex® and Lipoclean®.

The lipase enzyme may be present as an encapsulated lipase or as a non-encapsulated i.e. free lipase. By encapsulated, we herein mean that the enzyme is immobilized within a particle or the like and is not 'free' within the liquid detergent composition.

The encapsulated enzyme may be of the core-shell type, absorbed onto or into a matrix or a mixture thereof, preferably the encapsulated enzyme is of the core-shell type. A core-shell particle is one comprising an outer shell that surrounds a core, wherein the enzyme is comprised within the core.

When in encapsulated form the enzymes are typically encapsulated in a polymeric material. Methods of encapsulation of the enzymes are for example, by spray-drying a liquid composition containing the enzyme(s) and the polymer(s), or by drying a liquid composition containing the enzyme and polymer, or by emulsion polymerisation, coacervation, precipitation or interfacial polymerisation optionally in the presence of the enzyme, optionally followed by drying and/or size reduction processes. Suitable polymers for encapsulating enzymes include: polyvinyl alcohol, polyvinylpyrrolidone, carboxymethylcellulose, guar gum, polycarboxylic acid, methylcellulose, hydroxypropyl methylcellulose, proteins, polybranched polyamines, such as polyethyleneimines (PEI), (hydrophobically modified) polysaccharide modified cellulosic polymers, derivatives or co-polymers thereof and mixtures thereof. Examples of modified cellulosic polymers include hydroxypropyl methylcellulose phthalate, cellulose acetate phthalate Examples of modified gums include modified guar gum, gum benzoin, gum tragacanth, gum arabic and gum acacia. Examples of modified proteins are modified casein, gelatin and albumin. Examples of modified polymers may be selected from copolymers of at least one hydrophobic vinylic monomer with a least one hydrophilic vinylic monomer. Suitable hydrophilic vinylic monomer is vinylpyrrolidone. Suitable hydrophobic vinylic monomer is C1-C18 alkyl acrylates, C1-C18 alkyl methacrylates, C3-C18 cycloalkyl acrylates, C3-C18 cycloalkyl methacrylates and vinyl C1-C18 alkanoates and mixtures thereof. The polymer may comprise a polymer selected from homo- and copolymers having a C—C-backbone, wherein the C—C-backbone carries carboxyl groups, which may be present in the acidic form or in the neutralized form, and wherein the C—C-backbone comprises at least 20% by weight, e.g. from 20 to 98% by weight, based on the total weight of the polymer (i.e. based on the total weight of repeating units in the polymer P), of hydrophobic repeating units. The polymer may comprise branching, for example branched copolymer matrix particles formed from vinyl pyrrolidone and vinyl acetate. The polymer may comprise a copolymers, for example as described in WO2010/003934, based on maleic acid or (meth) acrylic acid. The polymer may be cross-linked.

Preferred polymers have a molecular weight from 1000 to 500,000, or 2000 to 200000 Dalton weight average. Typically, the weight ratio of enzyme to polymer is from 1:50 to 10:1.

The polymer may be selected to be substantially soluble in an aqueous solution having an ionic strength of 0 mol/kg and insoluble in an aqueous solution having an ionic strength of more than 1 mol/kg, for example in which the polymer comprises 35-95% w/w of hydrophilic monomer units, based on the total weight of the polymer.

Hydrophobically modified polyvinyl alcohol or hydrophobically modified polyvinyl pyrrolidone may be preferred, optionally with high levels of hydrolysis, greater than 60%, or even greater than 80 or 90%. Suitable hydrophobic modifying groups include keto-ester and/or butyryl groups and mixtures thereof and preferably the total degree of substitution (DS) is between about 3% and 20%.

The lipase enzyme, when present in an additive particle may be the only enzyme in the additive particle or may be present in the additive particle in combination with one or more additional enzymes.

Preferably, the shell material comprises a polymeric material, preferably selected from polyvinyl alcohol, polyvinylpyrrolidone, carboxymethylcellulose, guar gum, polycarboxylic acid, methylcellulose, hydroxypropyl methylcellulose, proteins, polybranched polyamines, such as polyethyleneimines (PEI), (hydrophobically modified) polysaccharide modified cellulosic polymers, derivatives or co-polymers thereof and mixtures thereof.

Preferably, the laundry detergent composition, preferably liquid laundry detergent composition comprises between 0.0001% and 0.75%, preferably between 0.0005% and 0.5%, more preferably between 0.001% and 0.5% by weight of the laundry detergent preferably liquid laundry detergent composition of the free or encapsulated lipase enzyme. Herein we mean that for the encapsulated enzyme the weight percentage of the enzyme protein only excluding the weight percentage of any other materials such as the shell that may be present in the encapsulate and 'encapsulated enzyme' refers to the enzyme present in the encapsulate as opposed to any other enzyme that may be present in the laundry detergent composition.

Preferably, the laundry preferably liquid laundry detergent composition comprises a non-soap anionic surfactant, preferably wherein the non-soap anionic surfactant comprises linear alkylbenzene sulphonate, alkoxylated alkyl sulphate or a mixture thereof, more preferably a mixture thereof wherein the ratio of linear alkylbenzene sulphonate to alkoxylated alkyl sulphate preferably the ratio of linear alkylbenzene sulphonate to ethoxylated alkyl sulphate is from 1:2 to 20:1, preferably from 1.1:1 to 15:1, more preferably from 1.2:1 to 10:1, even more preferably from 1.3:1 to 5:1, even more preferably from 1.4:1 to 3:1, most preferably from 1.4:1 to 2.5:1. Preferably the ethoxylated alkyl sulphate is an alkyl ethoxy sulphate comprising a mol average of 1 to 5, preferably 2 to 4, most preferably 3 ethylene oxide units per alkyl chain.

The laundry preferably liquid laundry detergent composition may comprise between 10% and 60%, preferably between 15% and 50% by weight of the laundry preferably liquid laundry detergent composition of surfactant. In terms of the present invention, the ethylene oxide-propylene oxide-ethylene oxide (EO/PO/EO) triblock copolymer of the present invention is not counted as a surfactant and as such does not contribute to the total level of surfactant. More preferably, the laundry preferably liquid laundry detergent composition comprises between 5% and 50%, preferably between 15% and 45%, more preferably between 25% and 40%, most preferably between 30% and 40% by weight of the detergent composition of the non-soap anionic surfactant.

Preferably, the laundry preferably liquid laundry detergent composition comprises less than 10% preferably less than 5%, preferably less than 3%, more preferably less than 2.5% by weight of the laundry detergent composition of a fatty alcohol ethoxylate non-ionic surfactant.

Preferably, the laundry preferably liquid laundry detergent composition comprises between 1.5% and 20%, more preferably between 2% and 15%, even more preferably between 3% and 10%, most preferably between 4% and 8% by weight of the laundry detergent composition of soap, preferably a fatty acid salt, more preferably an amine neutralized fatty acid salt, wherein preferably the amine is an alkanolamine more preferably selected from monoethanolamine, diethanolamine, triethanolamine or a mixture thereof, more preferably monoethanolamine.

The laundry, preferably liquid laundry detergent composition preferably comprises a non-aqueous solvent preferably selected from 1,2-propanediol, dipropylene glycol, tripropyleneglycol, glycerol, sorbitol or a mixture thereof. More preferably the liquid laundry detergent composition comprises between 10% and 40%, preferably between 15% and 30% by weight of the liquid laundry detergent composition of the non-aqueous solvent. Preferably, the weight ratio of non-aqueous solvent selected from 1,2-propanediol, dipropylene glycol, tripropyleneglycol, glycerol, sorbitol or a mixture thereof to the ethylene oxide-propylene oxide-ethylene oxide tri-block copolymer is between 1:1 and 10:1 more preferably between 2:1 and 5:1.

The laundry, preferably liquid laundry detergent composition preferably comprises an alkanolamine preferably selected from monoethanolamine, triethanolamine, and mixtures thereof, preferably monoethanolamine. The alkanolamine preferably is present between 5% and 15% by weight of the liquid laundry detergent composition.

Preferably, the laundry, preferably liquid laundry detergent composition comprises between 0.5% and 15%, preferably between 5% and 13% by weight of the liquid laundry detergent composition of water. Most preferably the liquid laundry detergent composition is enclosed in a water soluble film.

The laundry, preferably liquid laundry detergent composition may comprise a further enzyme. Preferably, the enzyme is selected from the group comprising hemicellulases, peroxidases, proteases, cellulases, xylanases, phospholipases, esterases, cutinases, pectinases, keratanases, reductases, oxidases, phenoloxidases, lipoxygenases, ligninases, pullulanases, tannases, pentosanases, malanases, ß-glucanases, arabinosidases, hyaluronidase, chondroitinase, laccase, and amylases, or mixtures thereof, preferably proteases, amylases, cellulases and mixtures thereof.

The laundry, preferably liquid laundry detergent composition may comprise a further polymer selected from the group comprising an alkoxylated polyethyleneimine, preferably an ethoxylated polyethyleneimine, a cationically modified polysaccharide, preferably a cationically modified hydroxyethylcellulose, a carboxymethylcellulose, preferably a hydrophobically modified carboxymethylcellulose, a polyester terephthalate soil release polymer, preferably an anionic polyester terephthalate soil release polymer, and an amphiphilic graft soil release polymer, preferably a polyethylene glycol graft polymer comprising a polyethylene glycol backbone and hydrophobic vinyl acetate side chains, or a mixture thereof. Preferably, the liquid laundry detergent composition comprises independently between 0.1% and 10%, preferably between 0.25% and 7%, more preferably between 0.5% and 5% by weight of the liquid laundry detergent composition of each of these polymers.

The laundry, preferably liquid laundry detergent composition may further comprise an adjunct ingredient selected from builders, dye transfer inhibiting agents, dispersants, enzyme stabilizers, catalytic materials, bleach, bleach activators, polymeric dispersing agents, antiredeposition agents, suds suppressors, aesthetic dyes, opacifiers, perfumes, perfume delivery systems, structurants, hydrotropes, processing aids, pigments and mixtures thereof.

Preferably, the laundry, preferably liquid laundry detergent composition has a pH between 6 and 10, more preferably between 6.5 and 8.9, most preferably between 7 and 8. The pH of the liquid laundry detergent composition may be measured as a 10% dilution in demineralized water at 20° C.

When liquid, the liquid detergent composition preferably has a viscosity of between 100 and 1000 cPa·s, measured at a shear rate of 20/s at 20° C. on a TA instruments AR-G2 or AR2000 using a 40 mm plate geometry and a 500 micron gap size.

Without wishing to be bound by theory, low viscosity allows higher manufacturing line speed, however, there is an increased risk of 'splashing' and 'stringing' in which liquid detergent accidentally contaminates the seal area and so results in seal defects. Such seal defects affects the structural integrity of the unit dose article. Increasing the viscosity avoids the issues of seal contamination but reduces manufacturing line speed. The preferred viscosity of the present invention allows for efficient manufacture line speed whilst minimizing seal contamination.

Method of Washing

A further aspect of the present invention is a method of washing comprising the steps of adding the laundry composition, preferably liquid laundry composition, more preferably a laundry composition enclosed in a water-soluble unit dose article according to the present invention to sufficient water to dilute the laundry detergent composition by a factor of at least 300 fold to create a wash liquor and contacting fabrics to be washed with said wash liquor.

Without wishing to be bound by theory, when the laundry composition is added to water, the laundry detergent composition disperses in the water to create the wash liquor.

Preferably the wash liquor may comprise between 1 L and 64 L, preferably between 2 L and 32 L, more preferably between 3 L and 20 L of water.

Preferably, the wash liquor is at a temperature of between 5° C. and 90° C., preferably between 10° C. and 60° C., more preferably between 12° C. and 45° C., most preferably between 15° C. and 40° C.

Preferably, washing the fabrics in the wash liquor takes between 5 minutes and 50 minutes, preferably between 5 minutes and 40 minutes, more preferably between 5 minutes and 30 minutes, even more preferably between 5 minutes and 20 minutes, most preferably between 6 minutes and 18 minutes to complete.

Preferably, the wash liquor comprises between 1 kg and 20 kg, preferably between 3 kg and 15 kg, most preferably between 5 and 10 kg of fabrics.

The wash liquor may comprise water of any hardness preferably varying between 0 gpg to 40 gpg.

Use

A further aspect of the present invention is the use of an ethylene oxide-propylene oxide-ethylene oxide (EO/PO/EO) triblock copolymer and a lipase in a laundry detergent composition to improve the grease cleaning performance of the laundry detergent composition according to the present invention. Most preferably the copolymer has a molecular weight between 2500 and 3000, a propylene oxide content between 25 and 35 propylene oxide units, and an ethylene oxide content of between 10 and 15 ethylene oxide units per ethylene oxide block.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

EXAMPLES

Example 1

The grease cleaning performance of a laundry detergent composition comprising an ethylene oxide-propylene oxide-ethylene oxide (EO/PO/EO) triblock copolymer and a lipase according to the invention (Inventive composition A) has been compared with the grease cleaning performance of compositions outside the scope of the invention, single variably lacking the lipase (Comparative Composition A), the ethylene oxide-propylene oxide-ethylene oxide (EO/PO/EO) triblock copolymer (Comparative Composition B) or both of them (Comparative Composition C).

Test Compositions:

| 100% wt active | Inventive Composition A | Comparative Composition A | Comparative Composition B | Comparative Composition C |
|---|---|---|---|---|
| Water | As Comparative Composition C | As Comparative Composition C | As Comparative Composition C | 9.8 |
| 1,2-Propanediol | | | | 12.22 |
| DiPropyleneGlycol | | | | 4.1 |
| Glycerine | | | | 4.1 |
| Sorbitol | | | | 0.06 |
| HLAS | | | | 23.2 |
| C24 HAE3S | | | | 15.9 |
| Nonionic alcohol ethoxylate (C24EO7/C24EO9) | | | | 3.1 /0.9 |
| Lutensol XL100 | | | | 0.5 |
| Citric Acid | | | | 0.9 |
| TC Fatty Acid | | | | 6.4 |
| Na DTPA chelant | | | | 0.9 |
| Ethoxylated polyethyleneimine (PEI600EO20)* | | | | 3.5 |
| Amphiphilic graft polymer** | | | | 2.2 |
| (EO-PO-EO) triblock copolymer (Selected from table below) | +14.8 ppm active through the wash | +14.8 ppm active through the wash | — | — |
| Lipase (Lipex 100L) | +0.2 ppm active enzyme through the wash | — | +0.2 ppm active enzyme through the wash | — |
| Sodium Formate (HCOONa) | As Comparative Composition C | As Comparative Composition C | As Comparative Composition C | 0.15 |
| Na Sulfite (NaHSO3) | | | | 0.4 |
| Hydrogenated Castor Oil | | | | 0.09 |
| Brightener 49 | | | | 0.2 |
| Monoethanolamine (MEA) | | | | 8.6 |

-continued

| 100% wt active | Inventive Composition A | Comparative Composition A | Comparative Composition B | Comparative Composition C |
|---|---|---|---|---|
| Minors (enzymes, anti-foam, perfume, preservative, dye) | | | | Balance to 100% |

*ethoxylated polyethyleneimine having an average degree of ethoxylation of 20 per EO chain and a polyethyleneimine backbone with MW of about 600
**polyethylene glycol graft polymer comprising a polyethylene glycol backbone (Pluriol E6000) and hydrophobic vinyl acetate side chains, comprising 40% by weight of the polymer system of a polyethylene glycol backbone polymer and 60% by weight of the polymer system of the grafted vinyl acetate side chains (EO-PO-EO) Triblock Copolymers According to the Invention

| Tradename | Type |
|---|---|
| Pluronic F127 | EO50PO56EO50 |
| Pluronic L4300 | EO6PO21EO6 |
| Pluronic L6400 | EO13PO30EO13 |

Test Methods:

Wash test: The grease cleaning performance of the different test samples has been assessed using a tergotometer. A Copley Tergotometer Detergent Tester or alike would be suitable. A set of stained fabrics were prepared by homogeneously distributing 200 uL of lard over 5×5 cm knitted cotton swatches (all supplied by Warwick Equest, Consett, County Durham, UK). Enough lard stains were prepared to conduct a wash experiment containing 2 internal repetitions and 4 external repetitions of the lard stain for each product treatment tested. Prior to washing, the L*a*b* colour values of the unstained fabric background and each stained fabric were measured (D65 light source, instrument model: Digi-Eye, supplier: VeriVide). 1 L of tap water (~8 US gpg water hardness and 27° C.) was then added to each tergotometer pot (internal volume ca 1 L) along with 0.74 g of Comparative C composition and further addition of the (EO-PO-EO) triblock copolymer and lipase for each of the test treatments at the dosages shown in the table above. Each of the product treatments was run in parallel across 8 tergotometer pots. The tergotometer was set to 208 rpm for 1 minute to dissolve each of the treatments, after the dissolution stage 2 lard stained test fabrics as well as clean knitted cotton ballast (5×5 cm) were added to give a total load weight of 60 g per tergotometer pot/treatment. The tergotometers were then set to agitate for 20 minutes at 208 rpm before being rinsed for 5 mins in 1 L clean tap water (~8 US gpg water hardness and 15° C.) at an agitation speed of 167 rpm. This procedure was repeated a further 3 times to give a total of 8 replicates (2 internal and 4 external) of each lard stain for each treatment. The fabrics were then line dried in the lab for 24 hours. Once fabrics were dry, the L*a*b* colour values were re-measured and the % stain removal (Stain removal Index—SRI) calculated using the formula below, the data reported is the average stain removal index across the 8 replicates tested:

$$SRI=100\times(AB-AC)/AB$$

Where:

A=Initial unwashed and unstained fabric background

B=Initial unwashed fabric stained region

C=Washed fabric stained region

The letter pairs in the above SRI calculation refer to the Delta E's between the colours of the two different regions of the fabric.

For example:

$$AB=\text{Delta } E=\ddot{O}((L^*_A-L^*_B)^2+(a^*_A-a^*_B)^2+(b^*_A-b^*_B)^2)$$

Test Results:

Grease Cleaning:

A synergistic grease cleaning performance is observed for the compositions comprising both the ethylene oxide-propylene oxide-ethylene oxide (EO/PO/EO) triblock copolymer and the lipase according to the invention (Inventive Compositions A) compared to Comparative Compositions A, B and C lacking the combined lipase-ethylene oxide-propylene oxide-ethylene oxide (EO/PO/EO) triblock copolymer. The synergy is observed for a range of ethylene oxide-propylene oxide-ethylene oxide (EO/PO/EO) triblock copolymers according to the invention.

| Grease cleaning | Pluronic F127 | Pluronic L4300 | Pluronic L6400 |
|---|---|---|---|
| Inventive composition A | 57 | 61 | 53 |
| Comparative Composition A | 43 | 46 | 49 |
| Comparative Composition B | 47 | 47 | 47 |
| Comparative Composition C | 45 | 45 | 45 |

Example 2

FIG. 1 discloses a water-soluble unit dose article (1) according to the present invention. The water-soluble unit dose article (1) comprises a first water-soluble film (2) and a second water-soluble film (3) which are sealed together at a seal region (4). The laundry detergent composition according to the invention (5) is comprised within the water-soluble soluble unit dose article (1).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A laundry detergent composition comprising a lipase and an ethylene oxide-propylene oxide-ethylene oxide (EO/PO/EO) triblock copolymer, wherein the copolymer comprises a first EO block, a second EO block, and a PO block, wherein the first EO block and the second EO block are linked to the PO block wherein the laundry detergent composition comprises between about 0.0001% and about 0.75%, by weight of the laundry detergent composition of the lipase, based on active protein, wherein the lipase is selected from a lipase which is a polypeptide having an amino acid sequence which:

(a) has at least about 90% identity with the wild-type lipase derived from *Humicola lanuginosa* strain DSM 4109; or (b) compared to said wild-type lipase, comprises a substitution of an electrically neutral or negatively charged amino acid at the surface of the three-dimensional structure within 15 angstroms of E1 or Q249 with a positively charged amino acid; or a mixture of (a) and (b).

2. The laundry detergent composition according to claim 1, wherein (a) or (b) or a mixture thereof comprises:

(a) a peptide addition at the C-terminal; or (b) a peptide addition at the N-terminal; or (c) characteristics i), ii), and iii) as follows:

i) a negative amino acid in position E210 of said wild-type lipase;

ii) a negatively charged amino acid in the region corresponding to positions 90-101 of said wild-type lipase; and iii) a neutral or negative amino acid at a position corresponding to N94 of said wild-type lipase and/or has a negative or neutral net electric charge in the region corresponding to positions 90-101 of said wild-type lipase;

(d) or a mixture thereof.

3. The laundry detergent composition according claim 1, comprising between about 0.0005% and about 0.5%, by weight of the laundry detergent composition of the lipase, based on active protein.

4. The laundry detergent composition according to claim 1, comprising between 1% and 10%, by weight of the composition, of the ethylene oxide-propylene oxide-ethylene oxide (EO/PO/EO) triblock copolymer.

5. The laundry detergent composition according to claim 1, wherein the ethylene oxide-propylene oxide-ethylene oxide (EO/PO/EO) triblock copolymer has an average propylene oxide chain length of between about 15 and about 70 propylene oxide units.

6. The laundry detergent composition according to claim 5, wherein the ethylene oxide-propylene oxide-ethylene oxide (EO/PO/EO) triblock copolymer has an average propylene oxide chain length of between about 20 and about 60 propylene oxide units.

7. The laundry detergent composition according to claim 1, wherein the ethylene oxide-propylene oxide-ethylene oxide (EO/PO/EO) triblock copolymer has an average molecular weight of between about 1000 and about 10,000.

8. The laundry detergent composition according to claim 7, wherein the ethylene oxide-propylene oxide-ethylene oxide (EO/PO/EO) triblock copolymer has an average molecular weight of between about 1500 and about 5000.

9. The laundry detergent composition according to claim 1, wherein each ethylene oxide chain independently has an average chain length of between about 2 and about 90 ethylene oxide units.

10. The laundry detergent composition according to claim 9, wherein each ethylene oxide chain independently has an average chain length of between about 3 and about 50 ethylene oxide units.

11. The laundry detergent composition according to claim 1, wherein the copolymer comprises on average between about 10% and about 90%, by weight of the copolymer, of the EO blocks.

12. The laundry detergent composition according to claim 11, wherein the copolymer comprises a total ethylene oxide content that is split over the two ethylene oxide blocks such that each ethylene oxide block comprises on average between about 40% and about 60% of the total number of ethylene oxide units, wherein the percentage of both ethylene oxide blocks together accounts for about 100% of the ethylene oxide units present.

13. The laundry detergent composition according to claim 1, wherein the copolymer has an average molecular weight between about 2500 and about 3000, an average propylene oxide content between about 25 and about 35 propylene oxide units, and an average ethylene oxide content of between about 10 and about 15 ethylene oxide units per ethylene oxide block.

14. The laundry detergent composition according to claim 1 comprising between about 10% and about 60%, by weight of the laundry detergent composition, of surfactant, excluding the ethylene oxide-propylene oxide-ethylene oxide (EO/PO/EO) triblock copolymer.

15. The laundry detergent composition according to claim 14, wherein the laundry detergent composition is a liquid laundry detergent composition, wherein:

a. the liquid laundry detergent composition comprises between about 5% and about 50%, by weight of the detergent composition of a non-soap anionic surfactant, or b. the liquid laundry detergent composition comprises less than about 10%, by weight of the laundry detergent composition, of a fatty alcohol ethoxylate non-ionic surfactant, or c. a mixture thereof.

16. The laundry detergent composition according to claim 1, wherein the laundry detergent composition comprises a non-soap anionic surfactant, wherein the non-soap anionic surfactant comprises linear alkylbenzene sulphonate, alkoxylated alkyl sulphate, or a mixture thereof.

17. The laundry detergent composition according to claim 16, wherein the non-soap anionic surfactant comprises linear alkylbenzene sulphonate and alkoxylated alkyl sulphate, and wherein the ratio of linear alkylbenzene sulphonate to alkoxylated alkyl sulphate is from about 1:2 to about 20:1.

18. The laundry detergent composition according to claim 1, wherein the laundry detergent compositions is a liquid laundry detergent composition, and wherein the liquid laundry detergent composition comprises a non-aqueous solvent selected from 1,2-propanediol, dipropylene glycol, tripropyleneglycol, glycerol, sorbitol, or a mixture thereof.

19. The laundry detergent composition according to claim 1 wherein the laundry detergent composition is a liquid laundry detergent composition, wherein the liquid laundry detergent composition comprises between about 0.5% and about 15%, by weight of the liquid laundry detergent composition of water.

20. The laundry detergent composition according to claim 1 wherein the laundry detergent composition is enclosed in a water-soluble film to form a water soluble unit dose article, wherein the water-soluble film comprises polyvinyl alcohol.

* * * * *